United States Patent [19]

Wakeman

[11] 4,008,636

[45] Feb. 22, 1977

[54] RATCHET WRENCH

[76] Inventor: Alfred W. Wakeman, Madison Road, Durham, Conn. 06422

[22] Filed: Apr. 21, 1975

[21] Appl. No.: 570,247

[52] U.S. Cl. ..... 81/68; 192/46

[51] Int. Cl.[2] ..... B25B 13/52

[58] Field of Search ..... 81/58.1, 58.5, 60, 61, 81/62, 68; 145/70, 71, 76; 192/46; 74/575

[56] References Cited

UNITED STATES PATENTS

| | | | |
|---|---|---|---|
| 672,461 | 4/1901 | Stansbury | 81/68 |
| 1,116,548 | 11/1914 | Bellows | 81/61 |
| 1,319,980 | 10/1919 | Von Tell | 81/68 |
| 1,359,325 | 11/1920 | Butler | 81/58.1 |
| 3,304,817 | 2/1967 | Swanstrom et al. | 81/68 X |

*Primary Examiner*—James L. Jones, Jr.
*Attorney, Agent, or Firm*—Kenneth H. Murray

[57] ABSTRACT

The ratchet wrench of this invention is of two piece construction comprising a rigid pawl handle, and a spring strap cooperating with the pawl handle. The pawl handle has a squared-off end and is provided with two integral pawl teeth extending from one side, which are adapted to engage and drive a splined bit. The spring strap is u-shaped, extending over the squared end and pawl teeth of the handle, and along both sides of the handle. The spring strap is fixed to the handle sides at its two co-extending ends to hold the spring strap and pawl handle in substantially fixed position.

The closed end of the spring strap extends in an arc over the squared end of the pawl handle in such a way as to define a D-shaped opening, adapted to receive and to precisely position the splined bit.

3 Claims, 8 Drawing Figures

FIG. 1
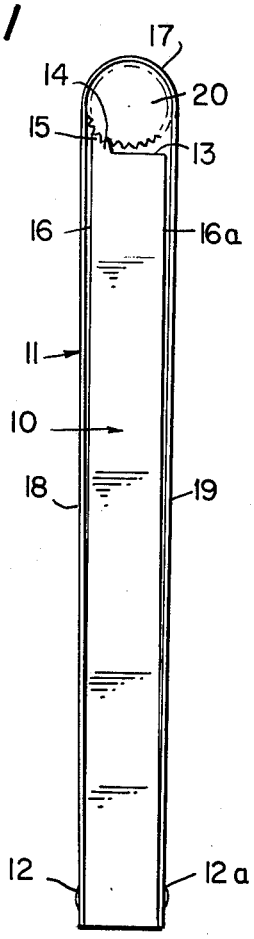
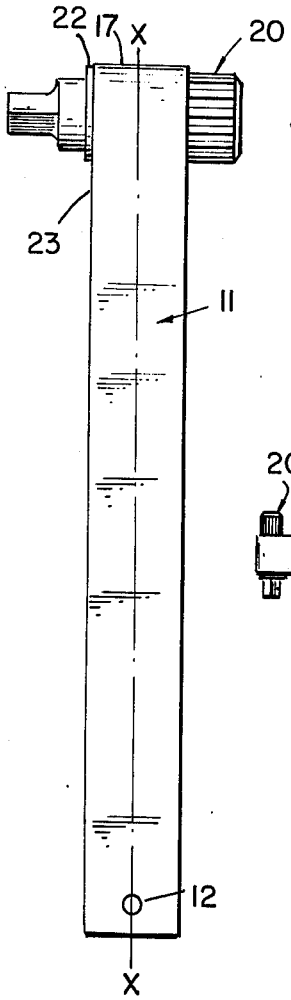
FIG. 2
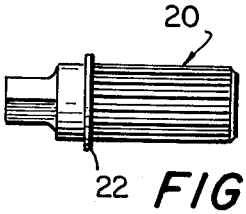
FIG. 3
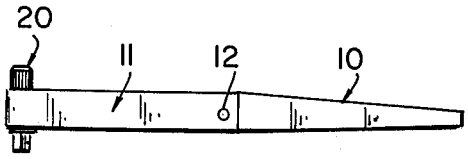
FIG. 7
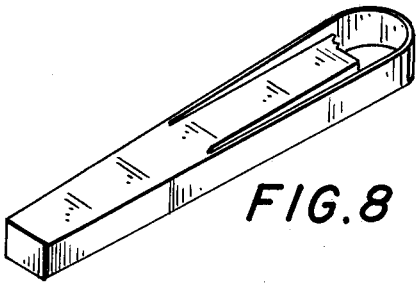
FIG. 8
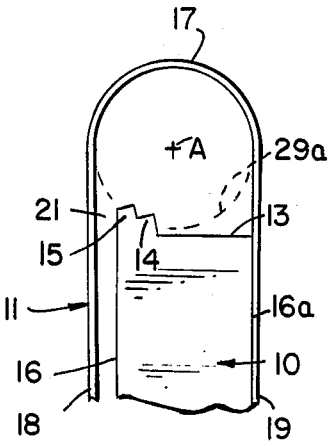
FIG. 4
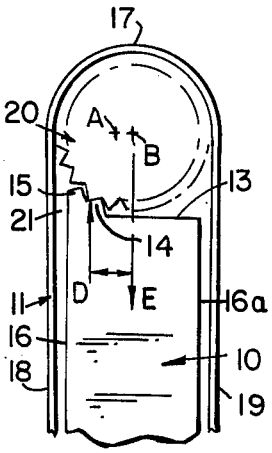
FIG. 5
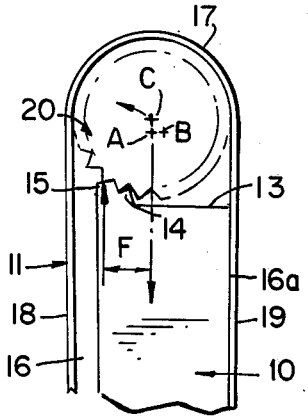
FIG. 6

RATCHET WRENCH

PRIOR ART

In the prior art ratchet wrenches adapted to receive interchangeable tool bits in a socket have included numerous parts, such as a rotatable ring or socket adapted to receive the tool bit, means for driving the bit, means on the outside of the ring such as teeth for driving the ring, means for supporting the ring on a fixed axis, cooperating ring driving means such as a pawl, a pawl spring to allow ratchet action, a housing adapted to hold the working parts in a fixed relationship, and a handle.

Ratchet wrenches of the type found in the prior art have several disadvantages. The ratchet head is relatively large since it contains parts to provide numerous separate functions arranged in successively larger diameters. These parts typically include a bit shank of sufficient diameter to transmit the required torque to the work, means for driving the bit within the socket, a socket ring of sufficient bulk to resist deformation or breaking under load, socket ring teeth of sufficient size and strength to resist breakage from tangential pressure of the pawl, and finally a housing of sufficient size and strength to contain the forces developed between the working parts.

Since the socket ring teeth must be relatively large for strength, the working arc of the handle required to engage successive teeth must also be large. The socket ring and housing are relatively complex and costly to manufacture in the socket wrenches of the prior art.

The present invention provides a ratchet wrench characterized by simplicity in construction, reduced bulk, reduced working arc and improved strength. In addition, the wrench of this invention provides two features not available in the ratchet wrenches of the prior art. The first of these features is an improved sensitivity similar to that of a torque wrench for better control in delicate operations, such as to avoid stripping of small screw threads. The second feature is a fail-safe construction which renders the ratchet wrench of this invention still operable after abusive use, such as exceeding the design torque limit.

SUMMARY OF THE INVENTION

The ratchet wrench of this invention consists of a rigid pawl handle and a spring strap operating with the pawl handle. The pawl handle has a squared-off end provided with two integral pawl teeth extending from one side of the squared-off end thereof, adapted to engage and drive a splined bit. The spring strap is generally U-shaped, and it extends over the squared-off end of the pawl handle, and along both sides of the pawl handle. The spring strap is fixed to the sides of the pawl handle at its two co-extending ends to hold the spring strap and the pawl handle in a substantially fixed position.

The spring strap extends in an arc over the squared-off end of the pawl handle to define a D-shaped opening adapted to receive and precisely position a splined bit.

In the ratchet wrench of this invention, the pawl acts directly on the tool bit, thus eliminating entirely the need for the conventional hollow socket. The pawl acts upon the splined bit at an angle directed well inside the rim of the bit so that its pressure is directed into the solid stock of the bit. The splines on the bit serve principally to start the binding action of the pawl on the bit and can therefore be made small and closely spaced. The splines are not subject to stripping or breakage since the ratchet can work equally as well on a bit of smooth round stock providing the stock is sufficiently soft for the pawl teeth to start a bite.

The pressure on the pawl teeth acts substantially parallel to the handle centerline, thus reducing the bulk required for handle stiffness. Resistance to pawl pressure is also substantially parallel to handle centerline and can, therefore, be provided by a thin spring strap under tension. The strap thickness is dependent upon a sectional area sufficient for the required tensil strength only, and no additional thickness is required to provide stiffness. Accordingly, the bulk of the ratchet head is made up only of the bit itself and a single thin spring strap.

For a better understanding of this invention, reference is made to the accompanying drawings which form a part of this specification in which:

FIG. 1 is a plan view of the ratchet wrench with a splined tool bit inserted in the ratchet head.

FIG. 2 is a side elevational view of the ratchet wrench with a splined tool bit inserted.

FIG. 3 is a side elevational view of a splined tool bit.

FIG. 4 is an enlarged plan view of the head of the ratchet wrench showing the position of the spring strap relative to the pawl handle prior to the insertion of the bit.

FIG. 5 is an enlarged plan view of the head of the ratchet wrench with a splined tool bit inserted.

FIG. 6 is an enlarged plan view of the head of the ratchet wrench showing the relative positions of the spring strap, the tool bit and the pawl handle when operating at full design torque load.

FIG. 7 is a side elevational view of the ratchet wrench showing an elongated pawl handle.

FIG. 8 is a perspective view of a variation of the ratchet wrench of this invention.

DESCRIPTION OF THE PREFERRED EMBODIMENT

Referring to the drawings, the ratchet wrench of this invention consists of only two parts, a pawl handle 10 and a spring strap 11, attached to the pawl handle at 12 and 12*a*, preferably by projection welding. The pawl handle 10 in its preferred form, is bar shaped, having one end 13 squared off from the side 16*a*. The squared end of the pawl handle is provided with two pawl teeth 14 and 15 extending from the squared end 13 and adjacent the side 16 of the pawl handle.

The spring strap 11 is generally U-shaped at its central portion or closed end 17, and has two legs 18 and 19 extending from the closed end to the point of attachment of the legs 18 and 19 at 12 and 12*a* of the pawl handle. The closed end of the spring strap 11 extends over the squared end 13 of the pawl to define a D-shaped opening or socket for receiving and precisely positioning a splined bit 20.

When the two parts of the ratchet wrench as described above are assembled, the pawl handle 10 is biased to a position shown in FIG. 4 whereby side 16*a* of the pawl handle is adjacent to leg 19 of the spring strap. The closed end 17 of the spring strap is shaped to closely conform to the diameter of the splined bit, and the pawl handle is somewhat less than the bit diameter to allow a space 21 between pawl handle side 16 and strap leg 18 in the assembled position. The pawl teeth 14 and 15 are now in interference position with the space to be occupied by the bit as shown by the dotted line A in FIG. 4.

The insertion of the bit moves the closed strap end 17 laterally in parallelogram fashion from the center A to center B in FIGS. 4 and 5, or to a position where the pawl teeth lie in engagement with the bit splines. The bit may now be pushed through the D-shaped opening until stop 22 on bit 20 rests against the edge 23 of spring strap 11 as shown in FIG. 2. The spring action in legs 18 and 19 of the spring strap provide resistance to lateral movement of the strap sufficient for spring retention of the bit in position, and for ratchet action when the pawl handle is rotated relative to the splined bit in a direction which causes the bit splines to displace the pawl teeth further toward space 21.

The rotation of the pawl handle in the driving direction allows the closed strap end to move toward its original position until full engagement of pawl tooth 14 in the first available bit spline is achieved as shown in FIG. 5. At this point, further rotation requires that the bit climb pawl tooth 14, which action is resisted by the closed end of the spring strap, creating forces represented by arrows D and E in a direction substantially parallel to the pawl handle centerline.

Additional torque on the bit is reflected in stress elongation of the spring strap. Changes in stress elongation of the spring strap result in angular movement of the ratchet handle relative to the bit. While this angular movement is extremely small within the design load limits, it is sufficient to provide the operator with a good sense of feel of the torque being applied to the work. Tooth 14 provides an initial delicate feel for sensitive light duty operation, and pre-stressing of the spring strap prior to the engagement of the second pawl tooth 15.

When the torque is increased, the splined bit will climb tooth 14 and engage tooth 15 as shown in FIG. 6. Tooth 15 is positioned outward of tooth 14, thus providing a larger moment F acting on the bit. After tooth 15 is engaged, the torque delivered to the bit is substantially increased with further incremental stress of the spring strap thus providing a heavy duty range up to the design limit of the ratchet wrench.

The engagement of the second tooth 15 by the bit doubles the holding area and increases the resistance to movement of the bit. Thus at full design load, two teeth of the pawl are in engagement with the splines of the bit, and the bit will have climbed up on the teeth of the pawl, stretching the spring strap to its full design tension.

At the design limit, the splined bit has climbed tooth 15 displacing laterally the closed end of the spring strap to a position F above its original position at B, and the pawl handle side 16*a* is again against leg 19 of the spring strap as shown in FIG. 6. In this position, further climbing of the tooth 15 caused by further pressure, will require bending leg 19 over the corner at 16*a*, thus effectively shortening leg 19. The feel of the tool will become extremely hard and the operator will easily realize that the design limit has been reached. A safety factor is provided in this embodiment in that considerable additional torque is required to put a permanent bend or elongation in leg 19.

When the design limit is exceeded, as when the ratchet wrench is abused by hammering, or forcing, the bit will climb over the top of the pawl tooth 15 until it ratches in the working direction, relieving further stress. In such a case, strap leg 19 will be permanently bent. By removing the bit, when the bit has been forced as above, and replacing the bit on the proper side of the pawl teeth, the ratchet wrench will still be operable at close to its original strength.

The ratchet wrench of this invention is reversible by virtue of the symmetry across its center plane as shown in FIG. 2. To reverse the action, the bit is removed from one side of the D-shaped opening and reinserted in the opposite side.

In the embodiment of the ratchet wrench shown in FIGS. 1 and 2, the spring strap 11 extends to the end of the pawl handle 10. Other equally serviceable embodiments may use a spring strap having legs shorter than the pawl handle as shown in FIG. 7.

The length of the pawl handle is generally selected relative to the design limit so that without abuse of the tool, such as in the case of hammering or using a pipe extension, the average user will not exceed the design limits.

In proportioning the tool's parts for specific service, the handle length is chosen to provide the desired leverage for the uses intended. Width, length and thickness of the spring strap are selected to provide the desired load limit, stress elongation, bit retention spring pressure, and ratchet action spring pressure. In the larger, heavy duty sizes, for example, it may be preferable to provide a pawl handle substantially longer than the spring strap, to provide sufficient leverage without proportionally increasing stress elongation.

It should be noted that I have described my invention as above in its preferred embodiment. In this embodiment, I have specified the use of a splined bit, however, it should be understood that the ratchet wrench of this invention works equally well on a smooth round bit of comparatively soft material, as the pawl teeth will bit a smooth bit of the type described. Other embodiments may include a permanently retained tool adapter in place of the removable splined bit, such as a square adapter for use with standard sockets, or by virtue of its simplicity and low cost, the ratchet wrench of this invention can be employed as a permanent ratchet handle in conjunction with apparatus or equipment requiring ratchet adjustments, as shown in FIG. 8 of the drawings.

I claim:

1. A ratchet wrench for applying unidirectional turning force on a grippable member comprising an elongated bar of rigid material terminating at one end in a projecting tooth extending transversely thereof adjacent one lateral edge, a relatively stiff elongated strap including elongated leg portions at either end thereof respectively merging into a U-shaped central portion providing an opening having a width only slightly greater than said bar at said toothed end thereof, said strap embracing said bar with the respective elongated strap leg portions extending along opposite sides of said bar, said U-shaped central portion enclosing said bar toothed end to define a closed periphery socket for axial reception of a said grippable member, means rigidly securing said strap leg portions to said bar along the sides thereof at points spaced a substantial distance from the toothed end of said bar, said U-shaped central portion of said strap thereby being restricted to limited lateral movement with respect to the said toothed end of said bar, thereby providing a one-way ratcheting action upon a grippable member received therein.

2. The ratchet wrench of claim 1 wherein said strap leg portions are secured to said bar at points substantially adjacent the other end of said bar.

3. The ratchet wrench of claim 1 wherein a second tooth of different length projects from said bar one end adjacent said first-named tooth.

* * * * *